US005380483A

United States Patent [19]

Watanabe et al.

[11] Patent Number: 5,380,483

[45] Date of Patent: Jan. 10, 1995

[54] VIBRATION-DAMPING ALLOY

[75] Inventors: Satoshi Watanabe, Mitaka; Kenzo Miura, Okayama; Toshinobu Okaku, Nakano; Hitoshi Okamoto; Youichi Sugiyama, both of Tamano, all of Japan

[73] Assignee: Mitsui Engineering & Shipbuilding Co., Ltd., Tokyo, Japan

[21] Appl. No.: 98,270

[22] PCT Filed: Dec. 26, 1991

[86] PCT No.: PCT/JP91/01770

§ 371 Date: Aug. 5, 1993

§ 102(e) Date: Aug. 5, 1993

[87] PCT Pub. No.: WO93/13234

PCT Pub. Date: Jul. 8, 1993

[51] Int. Cl.[6] ..... C22C 38/04

[52] U.S. Cl. ..... 420/73

[58] Field of Search ..... 420/73

[56] References Cited

U.S. PATENT DOCUMENTS

| | | | |
|---|---|---|---|
| 2,739,057 | 3/1956 | Payson | 420/73 |
| 3,330,651 | 7/1967 | Younkin | 420/73 |
| 4,009,025 | 2/1977 | Morelli | 420/73 |
| 4,512,804 | 4/1985 | Kos | 420/73 |
| 5,069,871 | 12/1991 | Fuller | 420/73 |

FOREIGN PATENT DOCUMENTS

| | | |
|---|---|---|
| 51-134308 | 11/1976 | Japan . |
| 51-139518 | 12/1976 | Japan . |
| 56-163241 | 12/1981 | Japan . |
| 57-094558 | 6/1982 | Japan . |
| 1-162746 | 6/1989 | Japan . |

*Primary Examiner*—Deborah Yee

*Attorney, Agent, or Firm*—Kanesaka & Takeuchi

[57] ABSTRACT

A vibration-damping alloy having excellent vibration-damping properties, high strength, and excellent workability and weldability has the composition defined by a triangle formed by connecting points A (89% by weight of M, 0.2% by weight of Ni, and 10.8% by weight of Mn), B (75% by weight of M, 15% by weight of Ni, and 10% by weight of Mn), and C (75% by weight of M, 0.2% by weight of Ni, and 24.8% by weight of Mn) in a triangular diagram showing the proportions of M, Ni and Mn in FIG. 1. M consists of Fe and Si, Fe and P, Fe and Al, Fe, Nb and C, Fe and Cu, Fe, Mo and C, or Fe, Ti and C.

4 Claims, 1 Drawing Sheet

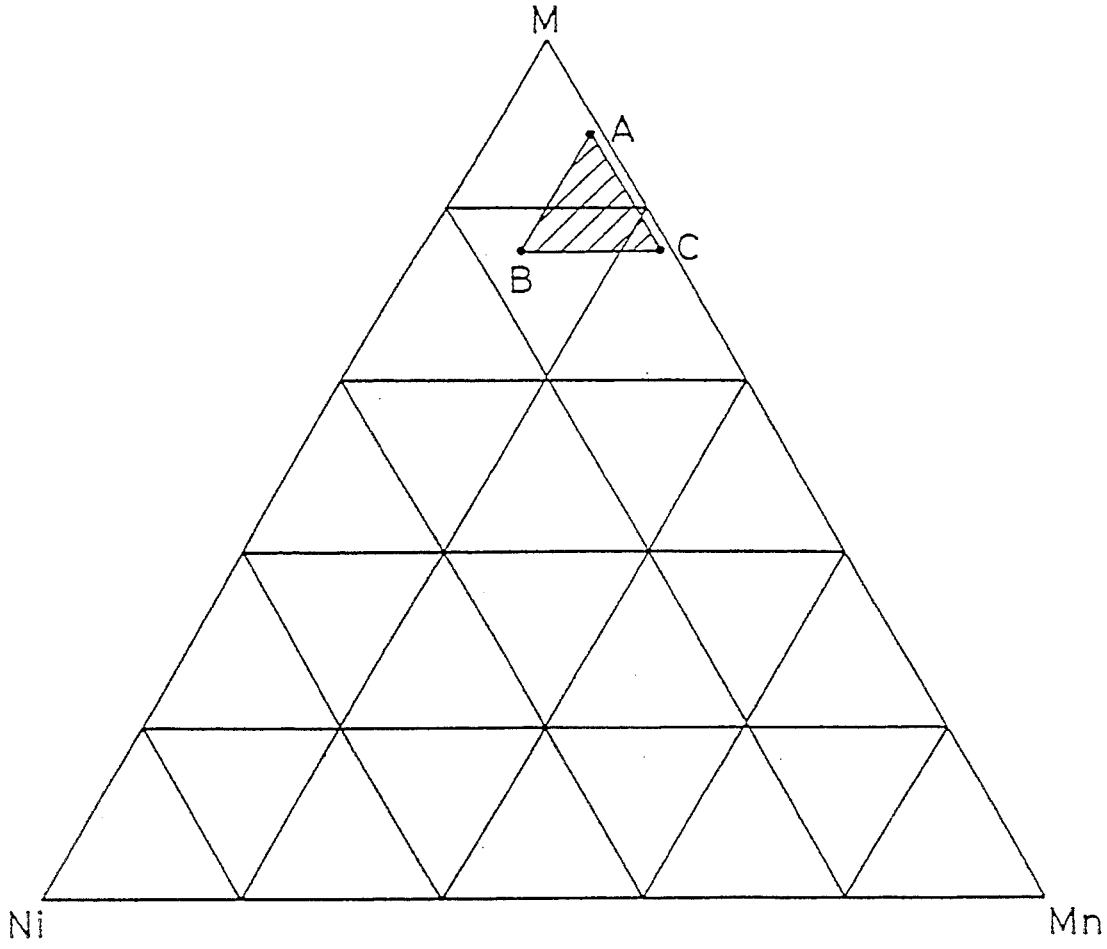
M
A
B
C
Ni
Mn

VIBRATION-DAMPING ALLOY

TECHNICAL FIELD

This invention relates to a vibration-damping alloy. More particularly, it is concerned with a vibration-damping alloy which utilizes movement of a twin and pseudo-elastic behavior of a stacking fault, is excellent in strength, workability and weldability, is inexpensive, and is, therefore, suitable for a variety of structural uses.

BACKGROUND ART

The vibration-damping alloys which absorb the vibration transmitted from an external source and reduce it rapidly have been studied for practical application in various fields of industry for the purpose of, for example, preventing any noise from being generated by the transmission of vibration.

The vibration-damping alloys are classified by their vibration-damping mechanism into four types as listed below:

(1) Soft ferromagnetic alloy;
(2) Thermoelastic martensite alloy;
(3) Al—Zn alloy; and
(4) Alloy relying upon a pseudo-elastic behavior.

The alloy as mentioned at (1) has the drawback of being incapable of damping vibration in the presence of an internal stress, and having, therefore, only a limited scope of applicability. The alloy as mentioned at (2) is too low in workability, and expensive for practical use. The alloy as mentioned at (3) is too low in strength to be sufficiently durable as a structural material.

The alloy as mentioned at (4) has been developed as a material not having any of the drawbacks as pointed out above. A vibration-damping alloy which relies upon the pseudo-elastic behavior of a stacking fault has been proposed in Japanese Patent Application Laid-Open No. 162746/1989. It discloses by way of example Fe—Ni—Mn Fe—Ni—Cr alloys having an austenitic structure, and a nickel content of 10 to 30%.

The above Japanese Application shows Fe—Ni—Mn Fe—Ni—Cr alloys as examples of the vibration-damping alloys. The strength of these alloys is, however, only as high as that of SUS304 stainless steel, and it is, therefore, desirable to improve their strength without lowering their vibration-damping properties.

This invention is a vibration-damping alloy intended as a solution to the above problems for improving the strength of one of the above alloys without lowering its vibration-damping properties, by adding to it a small amount of one or more elements selected from elements contributing to its solid-solution hardening, such as Si and P, and elements contributing to its precipitation hardening, such as Cu, Al, Mo, Ti, Nb, Be, N and B. It is an object of this invention to provide a novel vibration-damping alloy of relatively high strength which relies upon the movement of a twin and the pseudo-elastic behavior of a stacking fault, is excellent in strength, workability and weldability, is inexpensive, and is, therefore, suitable for use in making a variety of structural members or materials.

DISCLOSURE OF THE INVENTION

The vibration-damping alloy of this invention is an M—Ni—Mn alloy having the composition defined by a triangle formed by connecting points A(representing 89% by weight of M, 0.2% by weight of Ni and 10.8% by weight of Mn), B (75% by weight of M, 15% by weight of Ni and 10% by weight of Mn) and C (75% by weight of M, 0.2% by weight of Ni and 24.8% by weight of Mn) in a triangular diagram showing the composition of M, Ni and Mn in FIG. 1.

The alloy according to a first aspect of this invention is a quaternary alloy comprising Fe, Ni, Mn and Si which is obtained when M stands for Fe and Si.

The alloy according to a second aspect of this invention is a quaternary alloy comprising Fe, Ni, Mn and P which is obtained when M stands for Fe and P in the M—Ni—Mn alloy as defined above.

The alloy according to a third aspect of this invention is a quaternary alloy comprising Fe, Ni, Mn and Al which is obtained when M stands for Fe and Al in the M—Ni—Mn alloy as defined above.

The alloy according to a fourth aspect of this invention is a quinary alloy comprising Fe, Ni, Mn, Nb and C which is obtained when M stands for Fe, Nb and C in the M—Ni—Mn alloy as defined above.

The alloy according to a fifth aspect of this invention is a quaternary alloy comprising Fe, Ni, Mn and Cu which is obtained when M stands for Fe and Cu in the M—Ni—Mn alloy as defined above.

The alloy according to a sixth aspect of this invention is a quinary alloy comprising Fe, Ni, Mn, Mo and C which is obtained when M stands for Fe, Mo and C in the M—Ni—Mn alloy as defined above.

The alloy according to a seventh aspect of this invention is a quinary alloy comprising Fe, Ni, Mn, Ti and C which is obtained when M stands for Fe, Ti and C in the M—Ni—Mn alloy as defined above.

The vibration-damping alloy of this invention has the composition falling within the range defined by that area of the triangular diagram shown as FIG. 1 which is defined by points A to C defining the proportions of M, Ni and Mn as shown below, and marked by slanting lines.

TABLE 1

| | Composition (wt. %) | | |
|---|---|---|---|
| Point | M | Ni | Mn |
| A | 89 | 0.2 | 10.8 |
| B | 75 | 15 | 10 |
| C | 75 | 0.2 | 24.8 |

The alloy according to the first aspect of this invention contains Fe and Si as M, the alloy according to the second aspect thereof Fe and P as M, the alloy according to the third aspect thereof Fe and Al as M, the alloy according to the fourth aspect thereof Fe, Nb and C as M, the alloy according to the fifth aspect thereof Fe and Cu as M, the alloy according to the sixth aspect thereof Fe, Mo and C as M, and the alloy according to the seventh aspect thereof Fe, Ti and C as M.

Thus, the vibration-damping alloys according to the first to seventh aspects of this invention are each obtained by adding to an Fe—Ni—Mn alloy a small amount of an element or elements contributing to its precipitation hardening as selected from among Si, P, Al, Nb, C, Cu, Mo and Ti (hereinafter referred to as the "additional element or elements") to achieve a great improvement in its strength and an improvement in its oxidation resistance without lowering its vibration-damping properties.

The vibration-damping alloy of this invention relies for its vibration damping action upon the movement of a twin and the pseudo-elastic behavior of a stacking fault which occur in its structure. If, in a vibration-damping alloy of this type, a stacking fault has too low energy level, it grows excessively in the crystal, and the level of vibrating stress for showing a pseudo-elastic behavior becomes so high that the alloy does not readily respond to the stress. If the stacking fault has too high energy level, it does not grow to enable any satisfactory vibration-damping action.

Energy is absorbed by the movement of a twin, too.

The M—Ni—Mn alloy having the composition defined by the triangle formed by points A, B and C in FIG. 1 exhibits a satisfactory vibration-damping action by virtue of the behavior of a stacking fault having an appropriate energy level and the movement of a twin.

TABLE 2 below shows the appropriate proportions of Fe and the additional element or elements which compose M in each of the alloys according to the first to seventh aspects of this invention. If the proportion of the additional element (or elements) is smaller than the range shown in TABLE 2, the alloy does not have any satisfactorily improved strength or oxidation resistance. If it exceeds the range, the alloy is likely to have lower vibration-damping properties.

TABLE 2

| | Proportions of elements composing M (wt. %) Additional elements | | | |
|---|---|---|---|---|
| | Type | Preferred range | Optimum range | Fe |
| First aspect of the Invention | Si | 0.05–5.0 | 0.1–4.0 | Balance |
| Second aspect of the Invention | P | 0.05–5.0 | 0.1–4.0 | Balance |
| Third aspect of the Invention | Al | 0.05–5.0 | 0.1–2.0 | Balance |
| Fourth aspect of*1 | Nb | 0.01–5.0 | 0.05–5.0 | Balance |
| the Invention | C | 0.01–2.0 | 0.01–0.2 | Balance |
| Fifth aspect of the Invention | Cu | 0.5–5.0 | 2.0–4.0 | Balance |
| Sixth aspect of*2 | MO | 0.01–5.0 | 0.05–5.O | Balance |
| the Invention | C | 0.01–2.0 | 0.01–0.2 | Balance |
| Seventh aspect of*3 | Ti | 0.01–5.0 | 0.05–2.0 | Balance |
| the Invention | C | 0.01–2.0 | 0.01–0.2 | Balance |

*1Preferably C/Nb = 1/10 (by weight)
*2Preferably C/Mo = 1/10 (by weight)
*3Preferably C/Ti = 1/10 (by weight)

BRIEF DESCRIPTION OF THE DRAWING

FIG. 1 is a triangular diagram showing the composition of M, Ni and Mn.

BEST MODE OF CARRYING OUT THE INVENTION

The invention will now be described more specifically with reference to examples.

EXAMPLES 1 TO 9

Examination was made of the vibration-damping properties of the M—Ni—Mn alloys having the compositions shown in TABLE 3. The results are shown in TABLE 3.

It is obvious from TABLE 3 that the vibration-damping alloys of this invention have excellent vibration-damping properties.

The M—Ni—Mn alloys having the compositions shown in TABLE 3 were also found to have a tensile strength of 60 kg/mm$^2$ or more and an elongation of 35% or more.

TABLE 3

| | Example | 1 | 2 | 3 | 4 | 5 | 6 | 7 | 8 | 9 |
|---|---|---|---|---|---|---|---|---|---|---|
| Aloy composition (wt. %) | Fe | R | R | R | R | R | R | R | R | R |
| | Ni | 6 | 6 | 6 | 6 | 6 | 6 | 6 | 6 | 6 |
| | Mn | 14 | 14 | 14 | 14 | 14 | 14 | 14 | 14 | 14 |
| | Additional elements | | | | | | | | | |
| | Type | Si | Si | P | Al | Al | Nb C | Cu | MO C | Ti C |
| | Propotion (wt.%) | 0.3 | 0.7 | 0.2 | 0.2 | 0.5 | 0.3 0.03 | 3.0 | 3.0 0.03 | 1.0 0. |
| Vibration-damping properties (× $10^{-1}$) | | 10.3 | 9.5 | 10.0 | 10.5 | 9.5 | 8.0 | 9.8 | 8.8 | 8.0 |

R = Rest

INDUSTRIAL UTILITY

This invention provides a high-performance M (Fe and a specific additional element or elements)—Ni—Mn vibration-damping alloy which exhibits high vibration-damping properties by relying upon the pseudo-elastic behavior of a stacking fault, is very high in strength, and excellent in workability and weldability, is inexpensive, and is, therefore, suitable for use in making a variety of kinds of structural members or materials, as hereinabove described.

The vibration-damping alloy of this invention is not limited at all in the form of its use, but can be used to make a wide variety of structural members or materials, and to make castings, too. It can produce a good result of vibration damping even under the action of an internal stress. Therefore, it has a very high level of industrial utility.

We claim:

1. A vibration-damping alloy in the form of a quinary alloy consisting essentially of 0.2–15 wt % of Ni, 10–24.8 wt % of Mn, 0.01–5.0 wt % of Nb, 0.01–2.0 wt % of C and a remainder of Fe to thereby increase strength without lowering vibration-damping properties.

2. A vibration-damping alloy according to claim 1, wherein weight ratio of C:Nb is 1:10.

3. A vibration-damping alloy in the form of a quinary alloy consisting essentially of 0.2–15 wt % of Ni, 10–24.8 wt % of Mn, 0.01–5.0 wt % of Ti, 0.01–2.0 wt % of C and a remainder of Fe to thereby increase strength without lowering vibration-damping properties.

4. A vibration-damping alloy according to claim 3, wherein weight ratio of C:Ti is 1:10.

* * * * *